US006216565B1

(12) United States Patent
McCann

(10) Patent No.: US 6,216,565 B1
(45) Date of Patent: Apr. 17, 2001

(54) DRIVING CARTRIDGE SECURING MECHANISM TO WRENCH HANDLE

(76) Inventor: Frank McCann, 121 Yung Ho Road Ta Ya Hsiang, Taichung Hsien (TW)

( * ) Notice: Subject to any disclaimer, the term of this patent is extended or adjusted under 35 U.S.C. 154(b) by 0 days.

(21) Appl. No.: 09/342,036

(22) Filed: Jun. 28, 1999

(51) Int. Cl.[7] ..... B25B 23/16
(52) U.S. Cl. ..... 81/177.8; 81/60; 403/97
(58) Field of Search ..... 81/177.8, 177.7, 81/60, 440, 124.5; 403/97, 94

(56) References Cited

U.S. PATENT DOCUMENTS 4,406,186 * 9/1983 Gummow ..... 81/60
5,499,559 3/1996 Lin ..... 81/59.1
5,533,427 7/1996 Chow ..... 81/63.2
5,694,818 * 12/1997 Nickipuck ..... 81/60
6,000,299 * 12/1999 Cole ..... 81/60
6,032,555 * 3/2000 Whitley ..... 81/63.1

* cited by examiner

*Primary Examiner*—James G. Smith
*Assistant Examiner*—Hadi Shakeri
(74) *Attorney, Agent, or Firm*—Charles E. Baxley

(57) ABSTRACT

A wrench includes a driving cartridge having one end rotatably secured to a handle at a shaft and rotatable in a horizontal plane parallel to that of the handle. A pawl is slidably disposed between the driving cartridge and the handle and is selectively coupled to the driving cartridge for allowing the driving cartridge to be adjusted relative to the handle at any selected angular position. A barrel is rotatably disposed between the driving cartridge and the handle for receiving the pawl and coupled to the pawl for moving the pawl toward and away from the cartridge.

8 Claims, 6 Drawing Sheets

DRIVING CARTRIDGE SECURING MECHANISM TO WRENCH HANDLE

BACKGROUND OF THE INVENTION

1. Field of the Invention

The present invention relates to a wrench, and more particularly to a wrench having a securing mechanism for securing the driving cartridge to the handle.

2. Description of the Prior Art

Typical wrenches comprise a ratchet driving head secured to one end of a handle. Two kinds of the ratchet wrenches are disclosed in U.S. Pat. No. 5,499,559 to Lin, and U.S. Pat. No. 5,533,427 to Chow. The driving heads may not be rotated relative to the handle. The other typical wrenches comprise a driving head pivotally secured to one end of the handle at a lateral pivot shaft that is located in a horizontal plane of the handle such that the driving head will rotate about the horizontal plane and will be disengaged from the horizontal plane of the handle. The driving head may not be rotated in a plane parallel to the horizontal plane of the handle of the wrenches.

The present invention has arisen to mitigate and/or obviate the afore-described disadvantages of the conventional wrenches.

SUMMARY OF THE INVENTION

The primary objective of the present invention is to provide a wrench including a driving cartridge rotatably secured to the handle and rotatably secured to the handle at a shaft that is perpendicular to the horizontal plane of the handle for allowing the driving cartridge to be rotated in a horizontal plane parallel to the horizontal plane of the handle.

In accordance with one aspect of the invention, there is provided a wrench comprising a handle including a horizontal plane and including a first end, a driving cartridge including a first end having a driving mechanism provided therein and including a second end rotatably secured to the first end of the handle at a shaft, the driving cartridge including a horizontal plane parallel to the horizontal plane of the handle and rotatable about the shaft in the horizontal plane parallel to that of the handle, and means for selectively securing the driving cartridge at an angular position relative to the handle.

The selectively securing means includes a pawl slidably disposed between the second end of the driving cartridge and the first end of the handle, and means for selectively coupling the pawl to the second end of the driving cartridge. A barrel is rotatably disposed between the second end of the driving cartridge and the first end of the handle for rotatably receiving the pawl in the barrel. The barrel includes a knob extended outward therefrom for rotating the barrel. At least one first engaging member is provided in the second end of the driving cartridge and at least one second engaging member is provided in the pawl, and means for selectively engaging the first engaging member of the driving cartridge with the second engaging member of the pawl. The barrel includes means for selectively moving the pawl toward and away from the driving cartridge and to engage with and to disengage the second engaging member of the pawl from the first engaging member of the driving cartridge.

The selectively moving means includes at least one inclined groove formed in the pawl, and at least one projection extended from the barrel and slidably engaged in the inclined groove of the pawl for allowing the barrel to move the pawl toward and away from the driving cartridge when the projection of the barrel is moved along the inclined groove of the pawl. The pawl includes an opening communicating with the inclined groove for allowing the projection of the barrel to be engaged into the inclined groove of the pawl.

A spring biasing means is further provided for biasing the second engaging member of the pawl to engage with the first engaging member of the driving cartridge. The first end of the handle includes a depression formed therein, the biasing means includes a spring engaged in the depression of the handle and engaged with the pawl.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
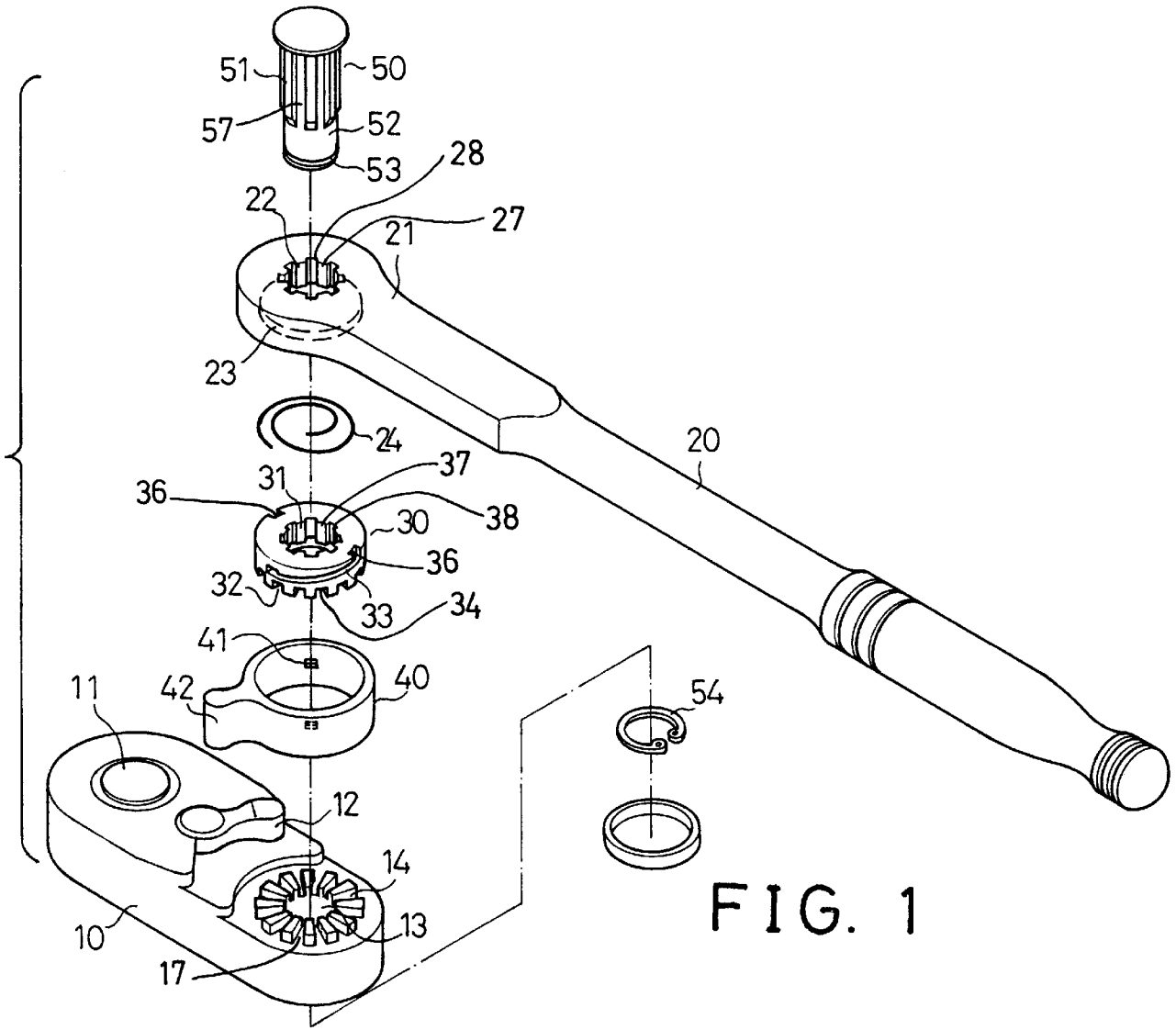
FIG. 1 is an exploded view of a wrench in accordance with the present invention.
Figure 2:
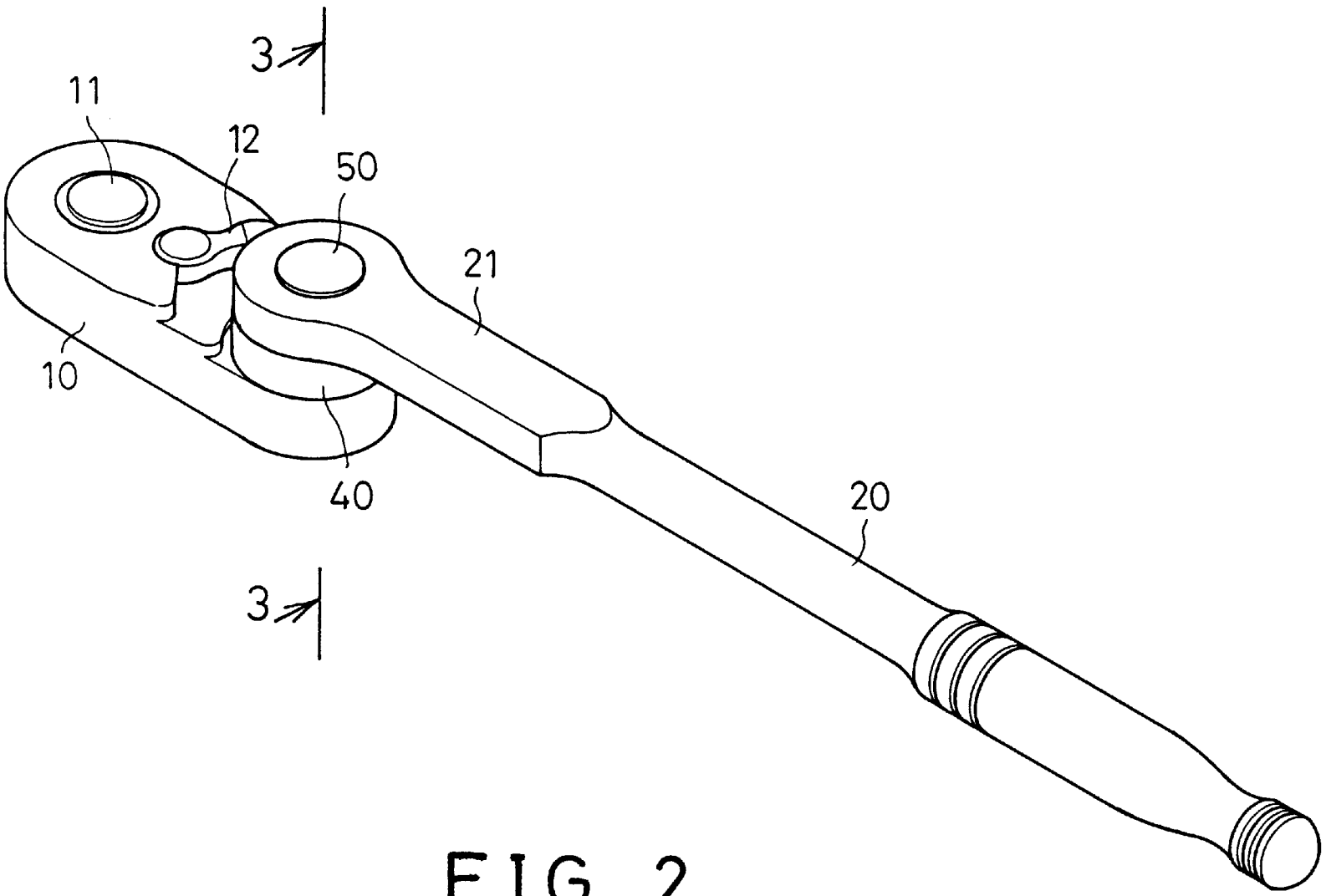
FIG. 2 is a perspective view of the wrench.
Figure 3:
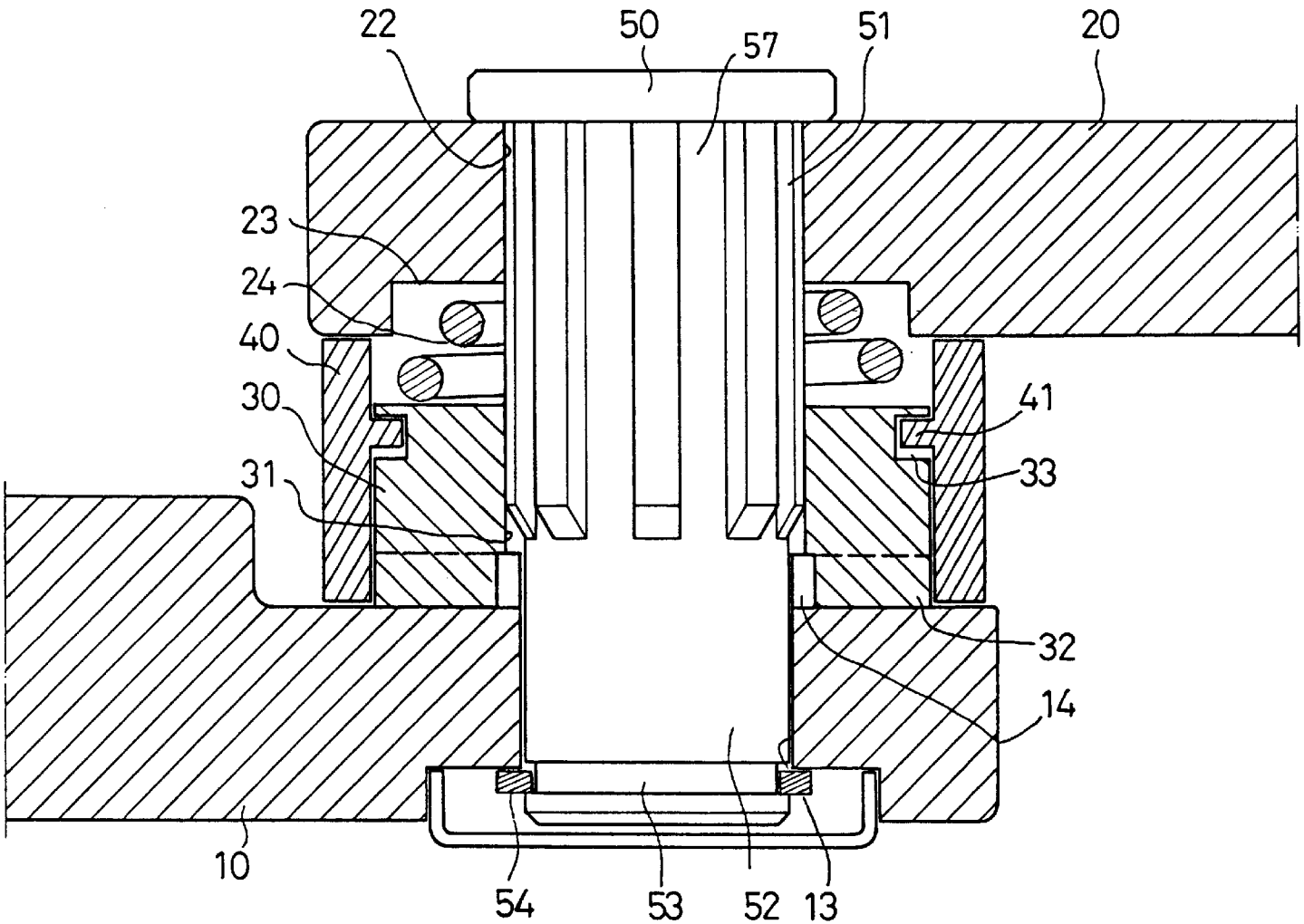
FIG. 3 is a cross sectional view taken along lines 3—3 of FIG. 2.

Referring to the drawings, and initially to FIGS. 1–3, a wrench in accordance with the present invention comprises a handle 20 including an orifice 22 formed in one end 21 thereof and perpendicular to a horizontal plane of the handle 20. The handle 20 includes one or more engaging members, such as the keys 27 extended inward of the orifice 22 thereof for defining one or more slots 28 between the keys 27 and includes a depression 23 formed in the bottom portion thereof for receiving a spring 24 therein. A driving cartridge 10 includes a driving mechanism 11, particularly a ratchet driving mechanism provided in one end for driving fasteners and includes a switch 12 pivotally secured therein and coupled to the ratchet driving mechanism for controlling the driving directions of the ratchet driving mechanism. Two kinds of the ratchet driving mechanisms are disclosed in U.S. Pat. No. 5,499,559 to Lin, and U.S. Pat. No. 5,533,427 to Chow, which are taken as a reference for the present invention. The driving cartridge 10 includes an aperture 13 formed in the other end thereof and perpendicular to a horizontal plane of the driving cartridge 10. The driving cartridge 10 includes one or more engaging members, such as the teeth 14 extended upward from the upper surface thereof and arranged around the aperture 13 thereof and defined by one or more recesses 17.

A barrel 40 is rotatably disposed between the one end 21 of the handle 20 and the other end of the driving cartridge 10, and includes a knob 42 extended radially outward therefrom for rotating the barrel 40 relative to the handle 20 and/or the driving cartridge 10. The barrel 40 includes one or more projections 41 extended radially inward therefrom. A pawl 30 is rotatably received in the barrel 40 and slidable between the one end 21 of the handle 20 and the other end of the driving cartridge 10 and includes one or more engaging members, such as the teeth 32 extended downward from the peripheral portion of the bottom surface thereof and defined by one or more recesses 34 for engaging with the recesses 17 and/or the teeth 14 of the driving cartridge 10. The spring 24 may bias the teeth 32 and/or the recesses 34 of the pawl 30 to engage with the recesses 17 and/or the teeth 14 of the driving cartridge 10. The pawl 30 includes a bore 31 formed therein and includes one or more keys 37 extended inward of the bore 31 thereof for defining one or more slots 38 between the keys 37. The pawl 30 includes an outer peripheral portion having one or more inclined grooves 33 formed therein and includes one or more openings 36 communicating with the grooves 33 respectively for allowing the projections 41 of the barrel 40 to be engaged into the grooves 33 of the pawl 30.

A shaft 50 is engaged through the orifice 22 of the handle 20 and the bore 31 of the pawl 30 and includes an annular groove 53 formed in the bottom portion thereof for engaging with a clamping ring 54 which may secure the driving cartridge 10 and the barrel 40 and the handle 20 together. The shaft 50 is perpendicular to the horizontal planes of the handle 20 and of the cartridge 10 and includes one or more engaging members, such as the ribs 51 extended radially outward therefrom and parallel to the longitudinal direction of the shaft 50 for defining one or more slots 57 and for slidably engaging with the slots 28, 38 and the keys 27, 37 of the handle 20 and the pawl 30, and for allowing the shaft 50 and the pawl 30 to be driven by the handle 20. The pawl 30 may be slided along the shaft 50 and may be prevented from rotating relative to the shaft 50. The shaft 50 includes a lower portion 52 having no ribs 51 extended therein for rotatably engaging into the aperture 13 of the driving cartridge 10 and for allowing the driving cartridge 10 to be rotated about the shaft 50 and to be rotated in a horizontal plane parallel to that of the handle 20. The engagement of the projections 41 of the barrel 40 in the inclined grooves 33 of the pawl 30 allows the barrel 40 to move the pawl 30 toward and away from the driving cartridge 10 by rotating the barrel 40 such that the teeth 32 and/or the recesses 34 of the pawl 30 may be forced to engage with or to be disengaged from the recesses 17 and/or the teeth 14 of the driving cartridge 10.

Figure 4:
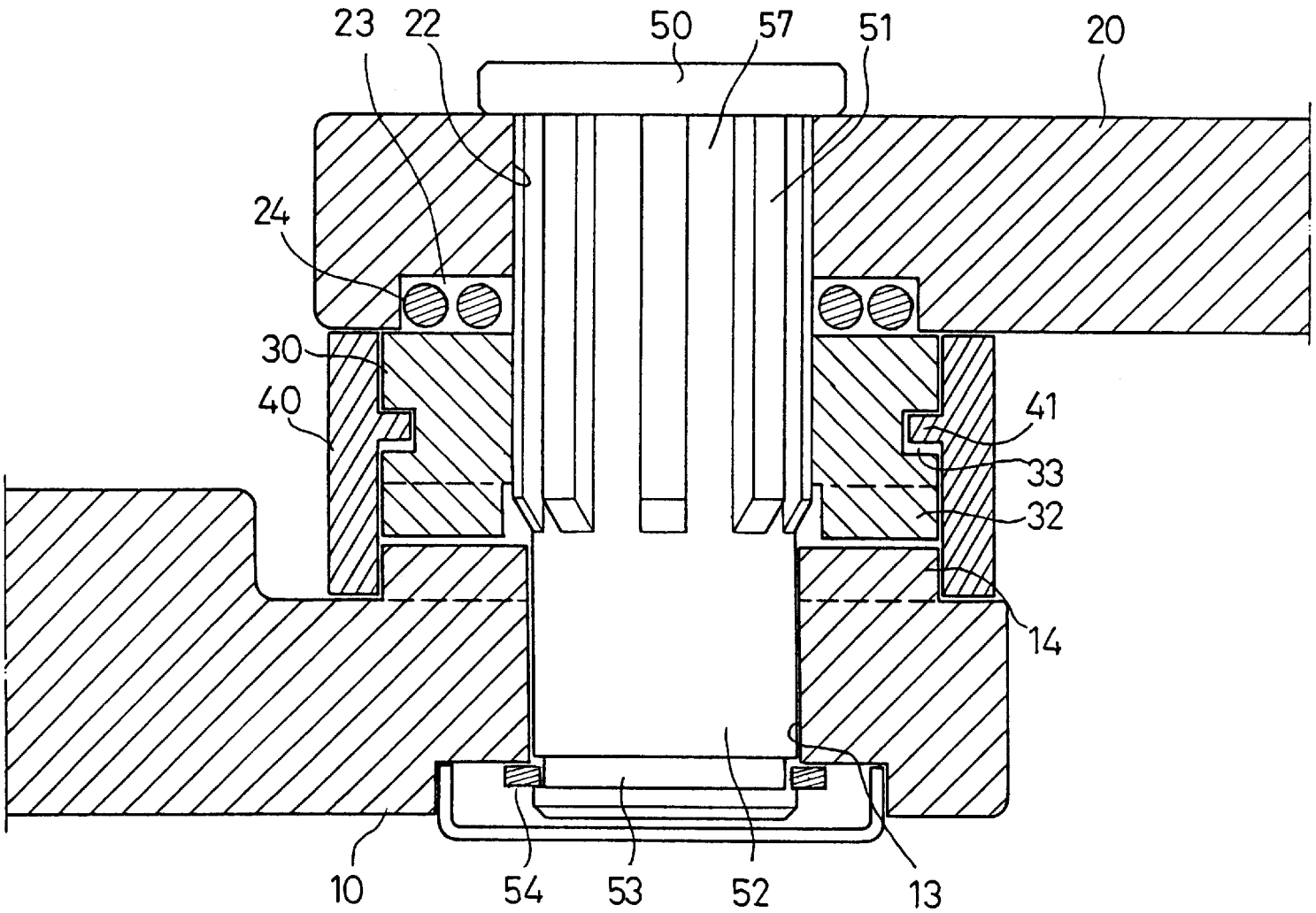
FIG. 4 is a cross sectional view similar to FIG. 3, illustrating the operation of the wrench.
Figure 5:
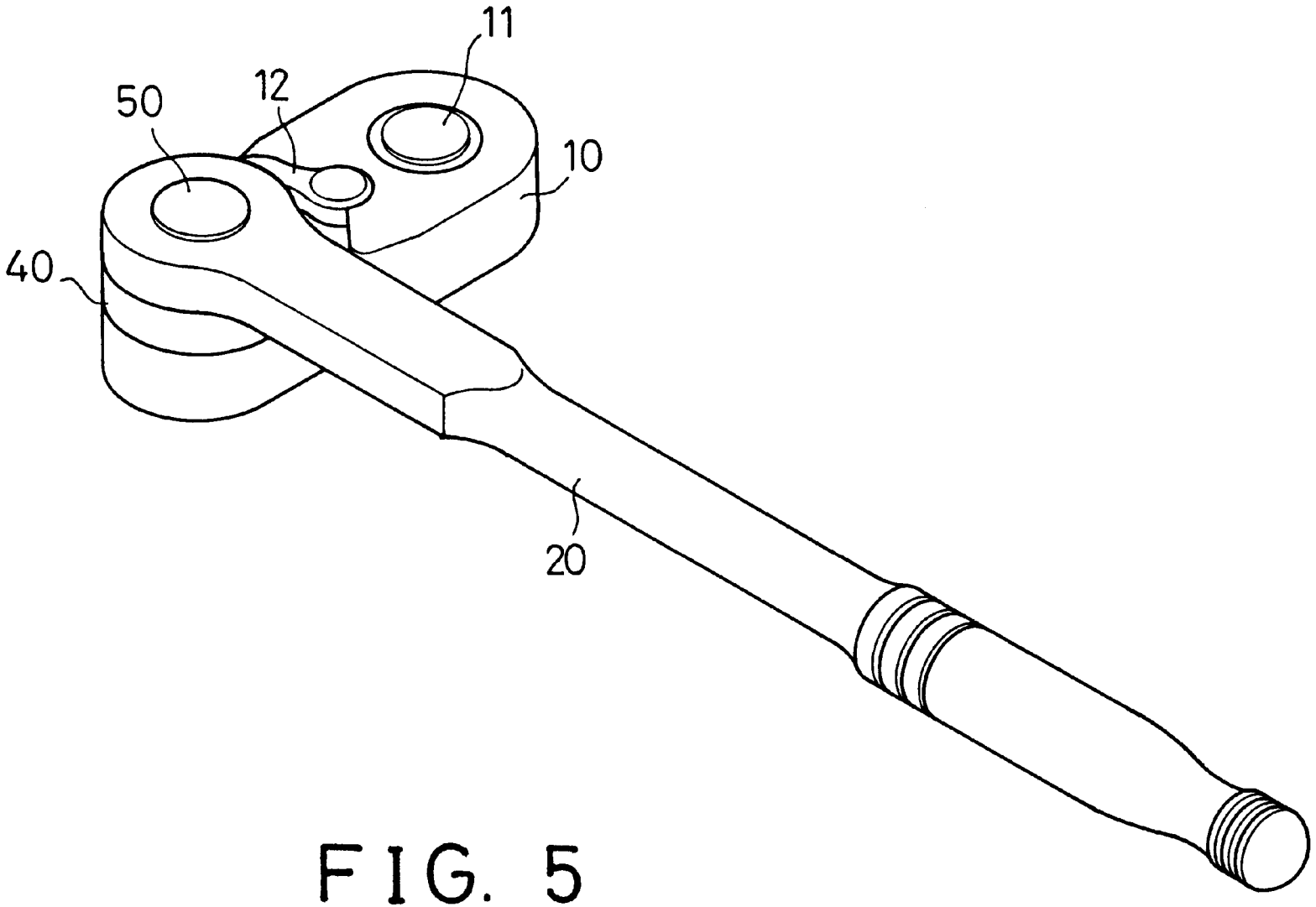
FIGS. 5 and 6 are perspective views illustrating the operation of the wrench.
Figure 6:
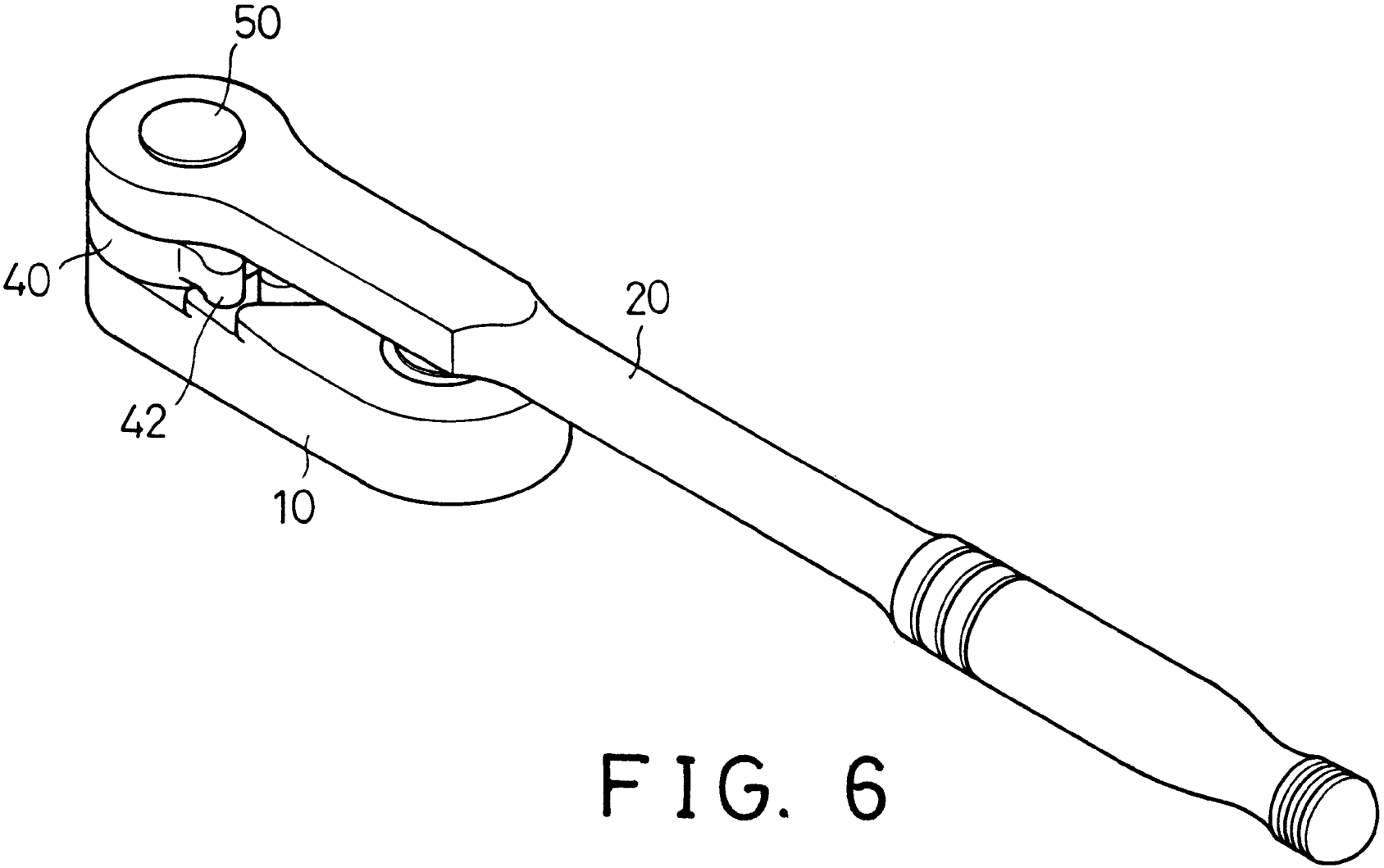

In operation, as shown in FIG. 3, the teeth 32 and/or the recesses 34 of the pawl 30 may be forced to engage with the recesses 17 and/or the teeth 14 of the driving cartridge 10 by the spring 24 such that the driving cartridge 10 may be driven and rotated by the handle 20. As shown in FIG. 4, when the projections 41 of the barrel 40 is moved along the inclined grooves 33 of the pawl 30 by rotating the barrel 40 with the knob 42, the pawl 30 may be moved away from the driving cartridge 10 such that the teeth 32 and/or the recesses 34 of the pawl 30 may be disengaged from the recesses 17 and/or the teeth 14 of the driving cartridge 10 and such that the driving cartridge 10 may be rotated about the shaft 50 in a horizontal plane parallel to that of the handle 20 (FIGS. 5, 6). The driving cartridge 10 may be rotated outward of the handle 20 for increasing the driving torque of the wrench, and may also be rotated to a position located downward of the handle 20 (FIG. 6) for reducing the size of the wrench and for decreasing the driving torque of the wrench.

Accordingly, the wrench in accordance with the present invention includes a driving cartridge rotatably secured to the handle and rotatably secured to the handle at a shaft that is perpendicular to the horizontal plane of the handle for allowing the driving cartridge to be rotated in a horizontal plane parallel to the horizontal plane of the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a handle including a horizontal plane and including a first end, a driving cartridge including a first end having a driving mechanism provided therein and including a second end rotatably secured to said first end of said handle at a shaft, said driving cartridge including a horizontal plane parallel to said horizontal plane of said handle and rotatable about said shaft in said horizontal plane parallel to that of said handle, means for selectively securing said driving cartridge at an angular position relative to said handle, said selectively securing means including a pawl slidably disposed between said second end of said driving cartridge and said first end of said handle, and means for selectively coupling said pawl to said second end of said driving cartridge, and means for guiding said pawl to slide along said shaft and to be rotated in concert with said shaft.

2. A wrench comprising:

a handle including a horizontal plane and including a first end, a driving cartridge including a first end having a driving mechanism provided therein and including a second end rotatable secured to said first end of said handle at a shaft, said driving cartridge including a horizontal plane parallel to said horizontal plane of said handle and rotatable about said shaft in said horizontal plane parallel to that of said handle, means for selectively securing said driving cartridge at an angular position relative to said handle, said selectively securing means including a pawl slidably disposed between said second end of said driving cartridge and said first end of said handle, and means for selectively coupling said pawl to said second end of said driving cartridge, and a barrel rotatably disposed between said second end of said driving cartridge and said first end of said handle for rotatably receiving said pawl in said barrel.

3. The wrench according to claim 2, wherein said barrel includes a knob extended outward therefrom for rotating said barrel.

4. A wrench comprising:

a handle including a horizontal plane and including a first end, a driving cartridge including a first end having a driving mechanism Provided therein and including a second end rotatable secured to said first end of said handle at a shaft, said driving cartridge including a horizontal plane parallel to said horizontal plane of said handle and rotatable about said shaft in said horizontal plane parallel to that of said handle, and means for selectively securing said driving cartridge at an angular position relative to said handle, said selevtively securing means including a pawl slidably disposed between said second end of said driving cartridge and said first end of said handle, and means for selectively coupling said pawl to said second end of said driving cartridge, said selectively coupling means of said bawl to said driving cartridge including at least one first engaging member provided in said second end of said driving cartridge and including at least one second engaging member provided in said pawl, and means for selectively engaging said at least one first engaging member of said driving cartridge with said at least one second engaging member of said pawl, wherein said selectively engaging means includes a barrel rotatably disposed between said second end of said driving cartridge and said first end of said handle for rotatably receiving said pawl in said barrel, said barrel includes means for selectively moving said pawl toward and away from said driving cartridge and to engage with and to disengage said at least one second engaging member of said pawl from said at least one first engaging member of said driving cartridge.

5. The wrench according to claim 4, wherein said barrel includes a knob extended outward therefrom for rotating said barrel.

6. The wrench according to claim 4, wherein said selectively moving means includes at least one inclined groove formed in said pawl, and at least one projection extended from said barrel and slidably engaged in said at least one inclined groove of said pawl for allowing said barrel to move said pawl toward and away from said driving cartridge and to engage with and to disengage said at least one second engaging member of said pawl from said at least one first engaging member of said driving cartridge when said at least one projection of said barrel is moved along said at least one inclined groove of said pawl.

7. The wrench according to claim 6, wherein said pawl includes an opening communicating with said at least one inclined groove for allowing said at least one projection of said barrel to be engaged into said at least one inclined groove of said pawl.

8. A wrench comprising:

a handle including a horizontal plane and including a first end, a driving cartridge including a first end having a driving mechanism provided therein and including a second end rotatably secured to said first end of said handle at a shaft, said driving cartridge including a horizontal plane parallel to said horizontal plane of said handle and rotatable about said shaft in said horizontal plane parallel to that of said handle, means for selectively securing said driving cartridge at an angular position relative to said handle, said selectively securing means including a pawl slidably disposed between said second end of said driving cartridge and said first end of said handle, and means for selectively coupling said pawl to said second end of said driving cartridge, said selectively coupling means of said pawl to said driving cartridge including at least one first engaging member provided in said second end of said driving cartridge and including at least one second engaging member provided in said pawl, and means for selectively engaging said at least one first engaging member of said driving cartridge with said at least one second engaging member of said pawl, means for biasing said at least one second engaging member of said pawl to engage with said at least one first engaging member of said driving cartridge and wherein said first end of said handle includes a depression formed therein, said biasing means includes a spring engaged in said depression of said handle and engaged with said pawl.

* * * * *